US011803157B1

(12) United States Patent
Xiong et al.

(10) Patent No.: US 11,803,157 B1
(45) Date of Patent: Oct. 31, 2023

(54) METAL WHEEL ROTATION DEVICE

(71) Applicant: Ruyuan Digital Technology (Shenzhen) Co., Ltd, Shenzhen (CN)

(72) Inventors: Jie Xiong, Jianou (CN); Bo Tang, Jianou (CN); Hairong He, Jianou (CN)

(73) Assignee: RUYUAN DIGITAL TECHNOLOGY (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 18/131,116

(22) Filed: Apr. 5, 2023

(30) Foreign Application Priority Data

Oct. 28, 2022 (CN) ..... 202222892822.8

(51) Int. Cl.
*G04B 3/04* (2006.01)
*G04B 37/06* (2006.01)

(52) U.S. Cl.
CPC ..... *G04B 3/041* (2013.01); *G04B 37/06* (2013.01)

(58) Field of Classification Search
CPC ..... G04B 3/041; G04B 3/043
See application file for complete search history.

(56) References Cited

U.S. PATENT DOCUMENTS 6,442,107 B1 * 8/2002 Takagi ..... G04B 19/30 368/282
7,404,669 B2 * 7/2008 Lambert ..... G04B 3/04 368/319
9,195,221 B2 * 11/2015 Oshita ..... G04G 17/04
9,671,757 B1 * 6/2017 Yuen ..... G04G 21/04
(Continued)

FOREIGN PATENT DOCUMENTS

CH 714912 B1 * 1/2022 ..... G04B 27/086
EP 3495896 A1 * 6/2019

OTHER PUBLICATIONS

Machine translation of EP 3495896 printed Jul. 24, 2023.*
Machine translation of CH 714912 printed Jul. 24, 2023.*

*Primary Examiner* — Amy Cohen Johnson

(57) ABSTRACT

The present disclosure relates to a metal wheel rotation device, comprising a watch body, which is provided with a watch case face cover and a watch case bottom cover at the upper and lower ends respectively, a watch case middle frame is fixedly arranged between the watch case face cover and the watch case bottom cover, a watch movement is sleeved in the watch case middle frame, and the watch movement is engaged in the watch case middle frame; an adjustment structure is provided in the middle position of one side of the watch case middle frame corresponding to a watch movement button, the adjustment structure is fixedly connected to the watch case middle frame by screws. This design transfers the adjustment structure of the watch case to the middle position. A rotating structure is composed of a rubber ring, a threaded rod metal structure and an external handle head. The rotating structure drives the watch movement to adjust and rotate. The ferrule is combined on the threaded rod metal structure, and the ferrule mainly serves as an adsorption and anti-slip effect, so that the original adjustment structure of the watch movement can be driven to rotate simultaneously when the external handle head rotates. The adjustment structure of the present disclosure is more convenient to use and has a more symmetrical appearance.

5 Claims, 1 Drawing Sheet

(56) References Cited

U.S. PATENT DOCUMENTS

| | | | | |
|---|---|---|---|---|
| 2006/0114753 | A1* | 6/2006 | Gerber | G04B 45/0092 368/295 |
| 2007/0215442 | A1* | 9/2007 | Ozawa | G04B 3/048 200/50.36 |
| 2008/0089185 | A1* | 4/2008 | Martin | G04B 43/00 368/282 |
| 2008/0273428 | A1* | 11/2008 | Damasko | G04B 19/283 368/295 |
| 2009/0245032 | A1* | 10/2009 | Bonnet | G04B 37/081 368/297 |
| 2010/0135128 | A1* | 6/2010 | Penula | G04B 45/0069 368/281 |
| 2012/0120779 | A1* | 5/2012 | Altenhoven | G04B 3/048 368/300 |
| 2012/0192424 | A1* | 8/2012 | Cataldo | B33Y 50/02 29/896.33 |
| 2013/0215724 | A1* | 8/2013 | Hiranuma | G04B 3/046 200/325 |
| 2014/0301169 | A1* | 10/2014 | Johansson | G04C 10/00 368/308 |
| 2016/0103420 | A1* | 4/2016 | Marcon | G04B 3/043 368/319 |
| 2019/0045642 | A1* | 2/2019 | Prest | G06F 1/163 |
| 2020/0233382 | A1* | 7/2020 | Katsuda | G04G 21/04 |
| 2021/0223744 | A1* | 7/2021 | Nakazawa | G04B 19/305 |
| 2022/0197222 | A1* | 6/2022 | Satou | G04B 37/005 |
| 2023/0103303 | A1* | 4/2023 | Kang | G04G 17/00 361/679.27 |

* cited by examiner

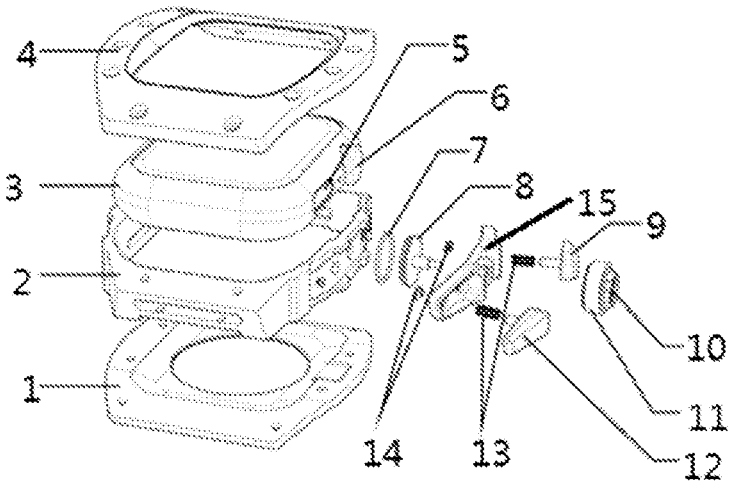
4
5
6
7
3
8
15
9
2
10
1
11
14
13
12

METAL WHEEL ROTATION DEVICE

TECHNICAL FIELD OF THE INVENTION

The present disclosure relates to the technical field of electronic watches, specifically a metal wheel rotation device.

BACKGROUND OF THE INVENTION

Electronic watches are watches that contain electronic circuits and can be classified as balance wheel electronic watches, tuning-fork watches and quartz watches depending on the vibration system or oscillator used. The adjustment structure corresponding to the watch movement of the existing electronic watch is uniformly arranged on the upper right side of the watch case. However, the analysis of the real-world use shows that arranging the adjustment structure in the middle of the watch case makes it easier and faster for the user to adjust, and more beautiful in appearance. Therefore, a person skilled in the art provides a metal wheel rotation device to solve the problem raised in the above-mentioned background art.

SUMMARY OF THE INVENTION

The object of the present disclosure is to provide a metal wheel rotation device to solve the problem raised in the above-mentioned background art.

To achieve the above object, the present disclosure provides the following technical solution:

A metal wheel rotation device, comprising a watch body, which is provided with a watch case face cover and a watch case bottom cover at the upper and lower ends respectively, a watch case middle frame is fixedly arranged between the watch case face cover and the watch case bottom cover, a watch movement is sleeved in the watch case middle frame, and the watch movement is engaged in the watch case middle frame; an adjustment structure is provided in the middle position of one side of the watch case middle frame corresponding to a watch movement button, the adjustment structure is fixedly connected to the watch case middle frame by screws; the right side of the watch movement is provided with the watch movement button and a watch movement handle head.

As a further technical solution of the present disclosure, the adjustment structure comprises a fixed case, a rotating structure, a handle head button, a handle head rubber sleeve, a button key, two key springs and two E-shaped retainer rings; the rotating structure includes a rubber ring, a threaded rod metal structure and an external handle head.

As a further technical solution of the present disclosure, the fixed case is provided with a small hole in the middle, and the two sides of the small hole are provided with a first fixing groove and a second fixing groove corresponding to the handle head button and the button key respectively; the first fixing groove and the second fixing groove are provided with a first through hole and a second through hole corresponding to the key springs.

As a further technical solution of the present disclosure, the two key springs are inserted in the first through hole and the second through hole respectively, one end of the key spring inserted in the first through hole is connected to the handle head button; one end of the key spring inserted in the second through hole is connected to the button key; the other ends of the two key springs are connected to the E-shaped retainer rings.

As a further technical solution of the present disclosure, the handle head button and the button key are engaged in the first fixing groove and the second fixing groove respectively.

As a further technical solution of the present disclosure, one end of the threaded rod metal structure is arranged between the fixed case and the watch case middle frame, and the other end of the threaded rod metal structure penetrates through the small hole in the middle of the fixed case and is sleeved with the external handle head, and the external handle head is sleeved with the handle head rubber sleeve.

Compared with the prior art, the present disclosure has the following advantageous effects:

This design transfers the adjustment structure of the watch case to the middle position. A rotating structure is composed of a rubber ring, a threaded rod metal structure and an external handle head. The rotating structure drives the watch movement to adjust and rotate. The ferrule is combined on the threaded rod metal structure, and the ferrule mainly serves as an adsorption and anti-slip effect, so that the original adjustment structure of the watch movement can be driven to rotate simultaneously when the external handle head rotates. The adjustment structure of the present disclosure is more convenient to use and has a more symmetrical appearance.

BRIEF DESCRIPTION OF THE DRAWINGS

The sole figure is a schematic view of the structure of a metal wheel rotation device.

In the figure: 1. watch case bottom cover; 2. watch case middle frame; 3. watch movement; 4. watch case face cover; 5. watch movement button; 6. watch movement handle head; 7. rubber ring; 8. threaded rod metal structure; 9. handle head button; 10. external handle head; 11. handle head rubber sleeve; 12. button key; 13. key spring; 14. E-shaped retainer ring; 15. fixed case.

DETAILED DESCRIPTION OF THE PREFERRED EMBODIMENT

The technical solutions of the embodiments of the present disclosure will be clearly and entirely described below with the drawings of the embodiments of the present disclosure. Obviously, the described embodiments are just a part of the embodiments of the present disclosure, and are not all of them. All other embodiments obtained by persons of ordinary skill in the art based on the embodiments of the present disclosure without creative efforts shall fall within the protection scope of the present disclosure.

Referring to the sole figure, in the embodiment of the present disclosure, a metal wheel rotation device, comprising a watch body, which is provided with a watch case face cover 4 and a watch case bottom cover 1 at the upper and lower ends respectively, a watch case middle frame 2 is fixedly arranged between the watch case face cover 4 and the watch case bottom cover 1, a watch movement 3 is sleeved in the watch case middle frame 2, and the watch movement 3 is engaged in the watch case middle frame 2.

An adjustment structure is provided in the middle position of one side of the watch case middle frame 2 corresponding to a watch movement button 5, the adjustment structure is fixedly connected to the watch case middle frame 2 by screws.

The right side of the watch movement 3 is provided with a watch movement button 5 and a watch movement handle head 6.

The adjustment structure comprises a fixed case 15, a rotating structure, a handle head button 9, a handle head rubber sleeve 11, a button key 12, two key springs 13 and two E-shaped retainer rings 14; the rotating structure includes a rubber ring 7, a threaded rod metal structure 8 and an external handle head 10.

The fixed case 15 is provided with a small hole in the middle, and the two sides of the small hole are provided with the first fixing groove and the second fixing groove corresponding to the handle head button 9 and the button key 12 respectively; the first fixing groove and the second fixing groove are provided with a first through hole and a second through hole corresponding to the key springs 13.

The two key springs 13 are inserted in the first through hole and the second through hole respectively, one end of the key spring 13 inserted in the first through hole is connected to the handle head button 9; one end of the key spring 13 inserted in the second through hole is connected to the button key 12; the other ends of the two key springs 13 are connected to the E-shaped retainer rings 14.

The handle head button 9 and the button key 12 are engaged in the first fixing groove and the second fixing groove respectively.

One end of the threaded rod metal structure 8 is arranged between the fixed case 15 and the watch case middle frame 2, and the other end of the threaded rod metal structure penetrates through the small hole in the middle of the fixed case 15 and is sleeved with the external handle head 10, and the external handle head 10 is sleeved with the handle head rubber sleeve 11.

The adjustment structure of the existing electronic watch is uniformly arranged on the upper right side. The design of the present disclosure changes the above structure by transferring the adjustment structure to the middle and making a major improvement in the design of the original electronic watch case. Since the original adjustment structure of the watch movement of the electronic watch is on the upper right side of the watch movement, this design transfers the adjustment structure of the watch case to the middle position. The rotating structure is composed of a rubber ring 7, a threaded rod metal structure 8 and an external handle head 10. The rotating structure drives the watch movement to adjust and rotate. The ferrule 7 is combined on the threaded rod metal structure 8, and the ferrule 7 mainly serves as an adsorption and anti-slip effect, so that the original adjustment structure of the watch movement can be driven to rotate simultaneously when the external handle head 10 rotates. The adjustment structure of the present disclosure is more convenient to use and has a more symmetrical appearance.

The above-mentioned are merely specific embodiments of the present disclosure, but the scope of protection of the present disclosure is not limited thereto. Any replacement or variation that can be easily conceived by a person skilled in the art within the technical scope disclosed in the present disclosure shall be covered by the scope of protection of the present disclosure.

The invention claimed is:

1. A metal wheel rotation device, comprising a watch body, which is provided with a watch case face cover and a watch case bottom cover at the upper and lower ends respectively, a watch case middle frame is fixedly arranged between the watch case face cover and the watch case bottom cover, a watch movement is sleeved in the watch case middle frame, and the watch movement is engaged in the watch case middle frame, wherein an adjustment structure is provided in the middle position of one side of the watch case middle frame corresponding to a watch movement button, the adjustment structure is fixedly connected to the watch case middle frame by screws;

the right side of the watch movement is provided with the watch movement button and a watch movement handle head; the adjustment structure comprises a fixed case, a rotating structure, a handle head button, a handle head rubber sleeve, a button key, two key springs and two E-shaped retainer rings; the rotating structure includes a rubber ring, a threaded rod metal structure and an external handle head.

2. The metal wheel rotation device according to claim 1, wherein the fixed case is provided with a small hole in the middle, and the two sides of the small hole are provided with a first fixing groove and a second fixing groove corresponding to the handle head button and the button key respectively; the first fixing groove and the second fixing groove are provided with a first through hole and a second through hole corresponding to the key springs.

3. The metal wheel rotation device according to claim 2, wherein the two key springs are inserted in the first through hole and the second through hole respectively, one end of the key spring inserted in the first through hole is connected to the handle head button; one end of the key spring inserted in the second through hole is connected to the button key; the other ends of the two key springs are connected to the E-shaped retainer rings.

4. The metal wheel rotation device according to claim 3, wherein the handle head button and the button key are engaged in the first fixing groove and the second fixing groove respectively.

5. The metal wheel rotation device according to claim 1, wherein one end of the threaded rod metal structure is arranged between the fixed case and the watch case middle frame, and the other end of the threaded rod metal structure penetrates through the small hole in the middle of the fixed case and is sleeved with the external handle head, and the external handle head is sleeved with the handle head rubber sleeve.

* * * * *